US006036057A

United States Patent [19]

Poutiatine

[11] Patent Number: 6,036,057

[45] Date of Patent: Mar. 14, 2000

[54] DUAL PISTON VARIABLE PROPORTIONING SYSTEM

[75] Inventor: Andrew I. Poutiatine, Portola Valley, Calif.

[73] Assignee: S.C. Johnson Commercial Markets, Inc., Sturtevant, Wis.

[21] Appl. No.: 09/112,714

[22] Filed: Jul. 9, 1998

Related U.S. Application Data

[62] Division of application No. 08/664,130, Jun. 14, 1996, abandoned.

[51] Int. Cl.[7] ..... B67D 5/52

[52] U.S. Cl. ..... 222/137; 222/145.5; 222/383.1; 222/564

[58] Field of Search ..... 222/383.1, 137, 222/134, 309, 145.5, 564, 547, 382; 239/333, 304

[56] References Cited

U.S. PATENT DOCUMENTS

| | | |
|---|---|---|
| D. 226,712 | 4/1973 | Tada . |
| 664,237 | 12/1900 | Deming . |
| 912,106 | 2/1909 | Frazier . |
| 2,941,696 | 6/1960 | Homm . |
| 2,973,883 | 3/1961 | Modderno . |
| 2,989,243 | 6/1961 | Turak . |
| 3,045,925 | 7/1962 | Giangualano . |
| 3,236,457 | 2/1966 | Kennedy et al. . |
| 3,303,970 | 2/1967 | Breslau et al. . |
| 3,311,265 | 3/1967 | Creighton, Jr. et al. . |
| 3,675,821 | 7/1972 | Morane et al. . |
| 3,701,478 | 10/1972 | Tada . |
| 3,760,986 | 9/1973 | Castner et al. . |
| 3,774,809 | 11/1973 | Bratton . |
| 3,786,963 | 1/1974 | Metzler, III . |
| 3,850,346 | 11/1974 | Richardson et al. . |
| 3,861,596 | 1/1975 | Nathan et al. . |
| 3,894,659 | 7/1975 | Focht . |
| 3,952,920 | 4/1976 | Bergman . |
| 4,027,785 | 6/1977 | Edstrometal . |
| 4,067,479 | 1/1978 | Moline . |
| 4,116,364 | 9/1978 | Culbertson et al. . |
| 4,265,372 | 5/1981 | Wainberg . |
| 4,355,739 | 10/1982 | Vierkotter . |
| 4,391,389 | 7/1983 | Catalfamo . |
| 4,471,888 | 9/1984 | Herb et al. . |
| 4,549,674 | 10/1985 | Alticosalian . |
| 4,566,610 | 1/1986 | Herb . |
| 4,690,306 | 9/1987 | Staheli . |
| 4,722,459 | 2/1988 | Goncalves . |
| 4,767,059 | 8/1988 | Crapser et al. . |
| 4,773,562 | 9/1988 | Gueret . |
| 4,790,454 | 12/1988 | Clark et al. . |
| 4,792,062 | 12/1988 | Goncalves . |
| 4,826,048 | 5/1989 | Skorka et al. . |
| 4,875,626 | 10/1989 | Buhler et al. . |
| 4,902,281 | 2/1990 | Avoy . |
| 4,911,328 | 3/1990 | Keller . |
| 4,917,158 | 4/1990 | Lingenhoff . |
| 4,925,066 | 5/1990 | Rosenbaum . |
| 4,958,754 | 9/1990 | Dennis . |
| 4,982,900 | 1/1991 | Blake . |

(List continued on next page.)

FOREIGN PATENT DOCUMENTS

| | | |
|---|---|---|
| 0 057 465 B1 | 9/1984 | European Pat. Off. . |
| 0 598 237 A2 | 10/1993 | European Pat. Off. . |
| WO 89/03804 | 5/1989 | WIPO . |
| WO 96/17800 | 6/1996 | WIPO . |

*Primary Examiner*—Philippe Derakshani
*Attorney, Agent, or Firm*—Fliesler, Dubb, Meyer & Lovejoy LLP

[57] ABSTRACT

A proportioning system 20 includes first and second cylinder and piston arrangements 26, 28 with an actuator 30 operably engaging the first and second cylinder and piston arrangement 26, 28. By changing the diameter and/or stroke of the pistons 54, 56, the mix ratio of two dispensed fluids changes. By changing the pivot point 32 of the actuator 30, the stroke length can be changed. The proportioning system 20 also includes a safety mechanism which prevents a concentrated fluid from being dispensed should the reservoir of diluting fluid be depleted.

9 Claims, 11 Drawing Sheets

U.S. PATENT DOCUMENTS 4,983,061 1/1991 Demarest .
4,993,594 2/1991 Becker et al. .
5,009,342 4/1991 Lawrence et al. .
5,020,694 6/1991 Pettengill .
5,127,547 7/1992 Gerich .
5,152,461 10/1992 Proctor .
5,169,029 12/1992 Behar et al. .
5,184,758 2/1993 Keller .
5,289,949 3/1994 Gentile .
5,310,091 5/1994 Dunning et al. .
5,332,157 7/1994 Proctor .
5,360,144 11/1994 Slade .
5,392,956 2/1995 Keller .
5,402,916 4/1995 Nottingham et al. .
5,439,141 8/1995 Clark et al. ..... 222/383.1
5,535,950 7/1996 Barriac et al. ..... 222/383.1
5,570,840 11/1996 Gettinger et al. .
5,752,626 5/1998 Bachand .

DUAL PISTON VARIABLE PROPORTIONING SYSTEM

CROSS REFERENCE

This application is a divisional of Ser. No. 08/664,130, filed Jun. 14, 1996, now abandoned.

The following U.S. patent applications, all owned by S.C. Johnson & Son, Inc., are cross-referenced and hereby incorporated by reference:

1. Title: MIX HEAD EDUCTOR

Inventor: Michael J. Greaney

U.S. Pat. No. 5,839,474

Issued: Nov. 24, 1998

2. Title: DISTRIBUTED CONCENTRATED CHEMICAL DISPENSING SYSTEM

Inventor: Gary L. Waymire, et al.

U.S. Pat. No. 5,765,605

Issued: Jun. 16, 1998

3. Title: DOCKING STATION AND BOTTLE SYSTEM

Inventor: Brent Duchon, et al.

U.S. Pat. No. 5,862,948

Issued: Jan. 26, 1998

FIELD OF THE INVENTION

The present invention is directed to proportioning systems which can dispense a mixture of two or more fluids.

BACKGROUND OF THE INVENTION

In large commercial and industrial settings such as hospitals, hotels, factories and the like, cleaning, disinfecting, and other health and maintenance functions requiring a major organized effort to ensure that these operations are carried out efficiently and economically. By way of example only, in large hotels and hospitals, it is not unusual to have one individual dedicated to simply refilling handheld spray bottles with cleaning and disinfecting agents. This means of course that each day or at regular intervals, the empty or partially empty spray bottles must be collected at a central location and then refilled. Collecting, refilling, and again distributing the bottles to worksites takes a toll on the efficient operation of such health and maintenance functions. Accordingly, it would be most beneficial if the amount of effort and time used to refill such handheld sprayers could be reduced.

Additionally, in such commercial and industrial settings, large scale mixing, diluting, and dispensing functions are carried out in specialized locations. Such functions can be accomplished, for example, at dishwashing or laundry stations, food dispensing stations, paint or epoxy mixing stations, and at a myriad of other stations. For such functions, concentrates such as soaps, disinfectants, paint pigments, epoxies, and the like, are delivered to the facility and then are mixed or diluted in a proportioning and dispensing system. Such concentrates can include, for example only, a block of soap that is to be placed in a large industrial dishwasher or other cleaner. In such situations the soap is dispensed into a stream of water by simply having the water directed over the block of soap. Such a system can understandably be wasteful in that the correct proportion of soap or other concentrate to the diluting fluid is not accurately measured.

Accordingly, there is a need to develop a system which can be used both as a handheld proportioner or as a large stationary proportioner for dispensing and proportioning substances in an accurate and economical way. Such system would be economical as only the exact desired mixture would be dispensed. Further, the system would need to be designed so that no one could come in contact with any concentrate.

SUMMARY OF THE INVENTION

The present invention is directed to overcome the disadvantageous of prior devices and systems.

Accordingly, the present invention is directed to a proportioning system which has at least a dual piston configuration for mixing together two fluids, one of which is preferably a concentrate, in a safe, accurate and economical manner. The system can be preferably configured either as a handheld trigger sprayer with two or more reservoirs for containing the fluids to be mixed and dispensed, or a large industrial stationary proportioning system such as found in a dishwashing or laundry system, or a paint or epoxy mixing system.

A handheld industrial or commercial proportioning system in line with the invention could for example accomplish a mix ratio of one to twenty, with two fluid reservoirs. The first reservoir would contain the concentrate and the second reservoir would contain fluids such as water. With a twenty to one ratio, it may be possible to use such a handheld sprayer for up to a month before the concentrate would have to be recharged. In such a situation, the reservoir containing the water could be recharged immediately at any time at any water tap. Such an arrangement of course would save the time of (1) returning handheld spray bottles to a central, normally basement, location, (2) recharging all the bottles, and (3) then re-dispensing the bottles to the designated worksites. Additionally, there would be savings in the shipping and handling of concentrated fluids.

The same sort of proportioning system could also be used in permanent locations for large scale equipment which mix and proportion paints, epoxies, and other chemicals.

Further, the embodiments of the present invention provide for adjusting the proportioner to affect the mix ratio of the several fluids which are being mixed together. The embodiments of the proportioning system of the invention demonstrate a plurality of advantageous configurations for changing the proportioning ratios. Some embodiments demonstrate that the proportioning ratios can be changed adaptively in real time according to changing conditions. These embodiments demonstrate a proportioning system which ensures that any concentrate is handled safely and cannot be dispensed should the diluting fluid become exhausted.

An embodiment of proportioning system of the invention for dispensing and mixing of two of more fluids comprises a first cylinder and piston arrangement adapted for pumping a first fluid from a first reservoir and a second cylinder and piston arrangement adapted for pumping a second fluid from a second reservoir. The two fluids, one preferably a concentrated fluid and the other a diluting fluid are pumped to a dispensing spray head. The mix ratio of the fluids, from one to one, up to one to fifty and beyond, can be adjusted in this inventive system in a number of manners.

In one aspect of the invention, the first and second cylinder and piston arrangements are operated with an actuator which can pivot about a pivot point. In this embodiment, the first and second cylinder and piston arrangements are positioned adjacent each other and can dispense a mixture of fluid depending on where the pistons are situated relative to the pivot point of the actuator. Movement of the actuator pivot point accordingly adjusts the mix ratio. Such movement can be accomplished through a manufacturing process or in the field. In a field environment the mix ratio can be changed adaptively.

In another aspect of the invention, the mix ratio can be affected by repositioning the cylinders with respect to each other and with respect to the pivot point of the actuator. The cylinders can remain parallel to each other or can be disposed of at an angle with respect to each other. Further, the cylinders can be disposed on opposite sides of the pivot point.

In yet another aspect of the invention, the mix ratio can be adjusted by adjusting the stroke of the piston in each of the first and second cylinder and piston arrangements as well as by changing the diameter of each cylinder. By changing the diameter of the cylinder and/or the stroke of the piston, the volume of fluid dispensed from each of these arrangements is changed, with a resultant change in the mix ratio.

In still a further aspect of the invention, the actuator can be a multiple lever actuator in order to effect an over-travel or lost-motion mechanism in order to change the stroke of each of the pistons and thus the mix ratio. Still further individual dials, cams, or other mechanisms can be affixed to the actuator and/or the first and second cylinder and piston arrangements in order to effect the mix ratio.

In yet another aspect of the invention, the first and second cylinder and piston arrangements can be interchangeable so that during the manufacturing process or in the field, the mix ratio can be changed by using a different cylinder and piston arrangement for an existing one. The different cylinder and piston arrangement would have either a different stroke or a different diameter in order to affect the volume of fluid dispensed.

In still a further aspect of the invention and in particular with respect to a handheld sprayer or dispenser having first and second reservoirs, the first reservoir would be adapted for containing the concentrate, and the second reservoir would have a filling port located distally from the spray head in order to effect convenient filling of that reservoir from an available water source.

In yet another aspect of the invention, the dispensing system prevents the dispensing of a concentrate when a diluting solution has been depleted.

Accordingly, it is an object of the present invention to provide for an efficient, economical and safe portioning system which can be used either in a handheld configuration or in a large industrial proportioning configuration.

Other aspects, objects and advantages of the invention can be obtained from a review of the specification and the drawings.

DETAILED DESCRIPTION OF THE PREFERRED EMBODIMENTS

Figure 1B:
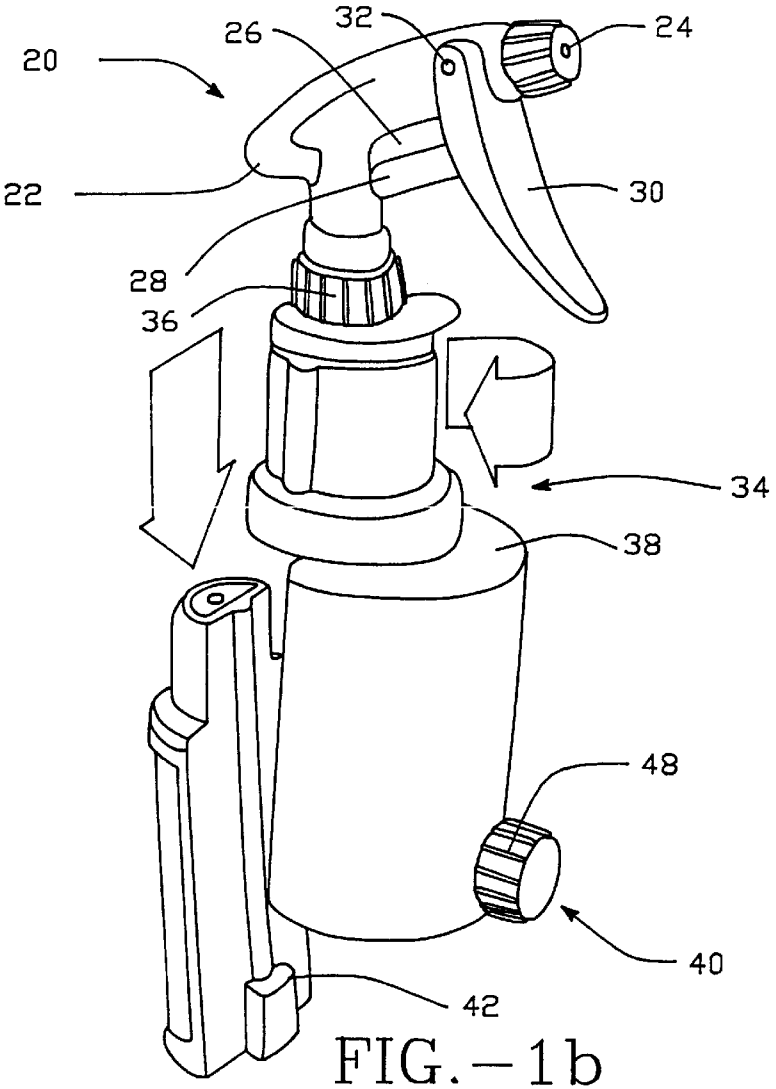
FIGS. 1*a* and 1*b* are embodiments of the proportioning system of the invention in a handheld dual piston trigger sprayer configuration.
Figure 1A:
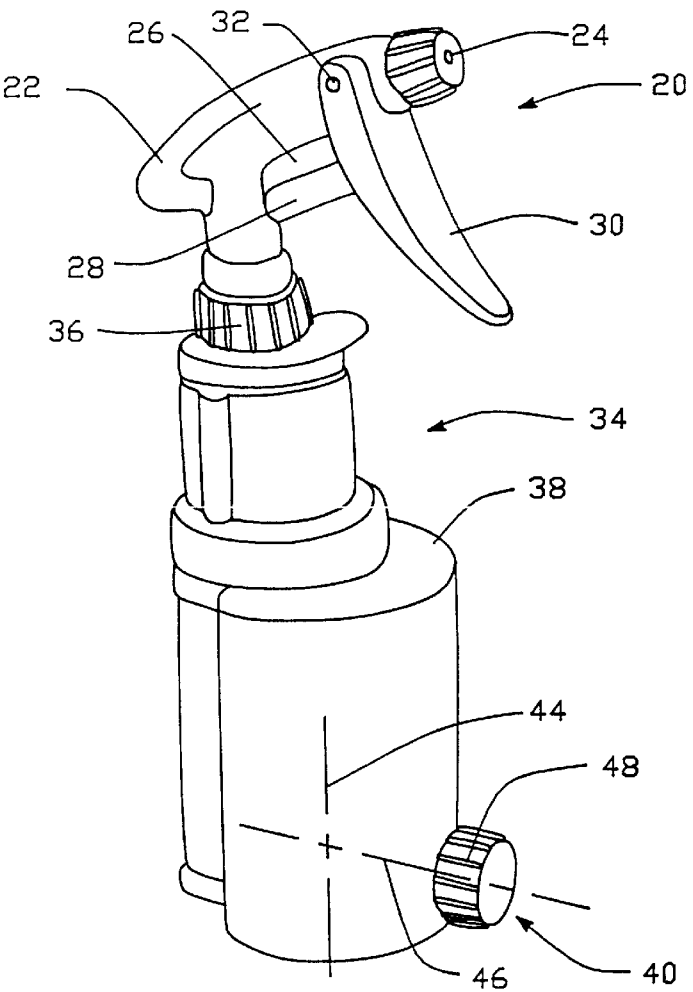

With reference to the figures and in particular FIGS. 1*a* and 1*b*, a handheld dual piston trigger sprayer 20 is depicted. Trigger sprayer 20 is one of the many embodiments of the proportioning system of the invention. As can be seen in FIGS. 1*a* and 1*b*, trigger system 20 includes a spray head 22, a spray nozzle 24, first and second cylinder and piston arrangements 26, 28, with longitudinal axes 27, 29, respectively, and an actuator or trigger lever 30. Actuator 30 is pivoted about pivot point 32. The spray head 22 is secured to a base 34 with attachment mechanism 36. Base 34 includes in this particular embodiment a large first reservoir 38 with a filling port 40. A second reservoir 42 is removable and securable to the base 34 so that it is positioned adjacent to the first reservoir 38. The first and second reservoirs 38, 42, communicate with the spray head 22. Preferably the second reservoir 42 is filled with a concentrate such as a concentrated soap, cleaner or disinfectant. The first reservoir 38 is filled with a diluting fluid such as water. Through the spray head 22, the ratio of mixing of the water to the concentrated fluid is determined and the mixture dispensed.

The filling port 40 is preferably located at an end of the first reservoir 38 as shown in FIGS. 1*a* and 1*b*, which end is distally located from the spray head 22. As can be seen in these figures, the trigger sprayer 20 is elongated along a longitudinal axis 44 which can be drawn from the end including the spray head 22, and through the body of the sprayer 20 adjacent to the filling port 40. The filling port then lies on a radial line 46 substantially perpendicular to the longitudinal axis 44. The advantage of this configuration is that when the diluting fluid becomes depleted, the first reservoir 38 can conveniently be recharged without removing the spray head 22 from the base 34 as is conventionally done with trigger sprayers. By tipping the sprayer 20 by 90° and removing the cap 48, the first reservoir 38 can be conveniently filled through port 40 under a convenient water tap. This arrangement has the additional advantage that there is no requirement that a deep bowl industrial sink be available in order to accommodate the elongated length of the base 34 with the spray head 22 removed. All that is necessary is that the sink accommodate the diameter of the first reservoir 38 which is perpendicular to the elongated axis 44.

Figure 2:
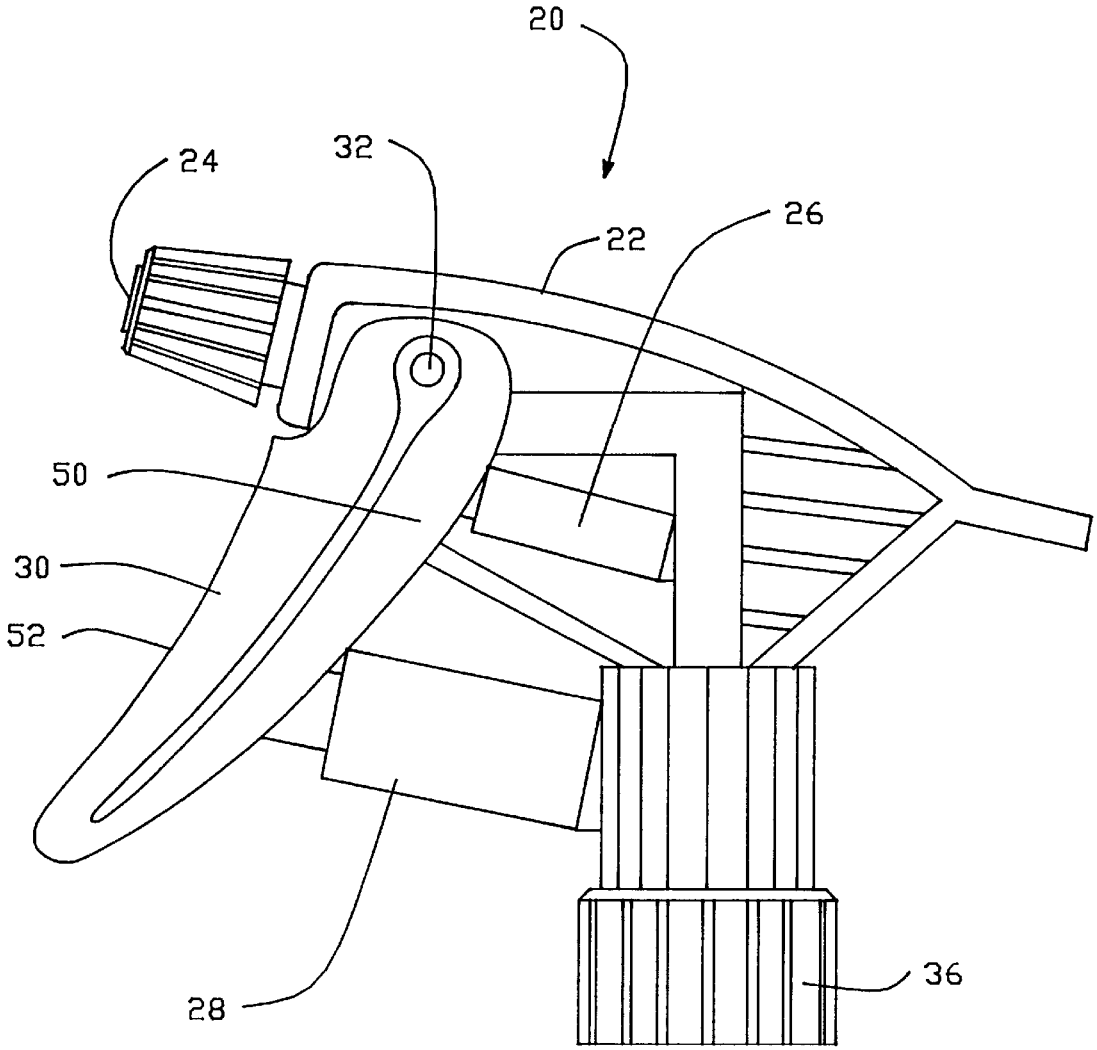
FIG. 2 is a side view of a dual piston trigger sprayer configuration of the proportioning system of the invention showing the cylinders placed with respect to each other and respect to a pivot point.

A side view of an embodiment of the trigger sprayer 20 is shown in FIG. 2. In this embodiment the first cylinder and piston arrangement 26 is parallel to but spaced from the second cylinder and piston arrangement 28. Additionally, it can be seen that the diameter and volume of the first cylinder and piston arrangement 26 are smaller than those of the second cylinder and piston arrangement 28. This figure demonstrates the great versatility of the present invention. By adjusting the position where the actuator 30 engages the first and/or second cylinder and piston arrangement 26, 28, and also the diameter of the first and/or second cylinder and piston arrangement 26, 28, the volume of fluid from the first reservoir that is pumped and mixed with respect to the volume of the fluid from the second reservoir can be adjusted in order to obtain a range of mix ratios from one to one, to several thousands to one, and beyond.

By way of example only, a mix ratio of fifty to one can be accomplished by having the point of engagement 50 of the first cylinder and piston arrangement 26 with actuator 30 be placed a distance of one unit from the pivot point 32. The point of engagement 52 of the second cylinder and piston arrangement 28 with actuator 30 is then placed a distance of four units from the pivot point 32. Assuming the same length of stroke of each piston, the diameter of the second cylinder and piston arrangement 28 could be about 0.5 inches (12.7 mm) while the diameter of the first cylinder and piston arrangement 26 could be about 0.14 inches (3.6 mm rain order to accomplish the fifty to one mix ratio. Similarly, the same mix ratio could be accomplished with the diameter of the second cylinder and piston arrangement 28 being about 0.75 inches (19 mm) and the diameter of the first cylinder and piston arrangement 26 being about 0.21 inches (5.3 mm). Additionally, by varying the length of the stroke of the piston in each of the first and second arrangement 26, 28, the volume of the fluid pumped by each arrangement 26, 28, can also be adjusted. Thus, several dimensions can be selected for this embodiment in order to effect a change in the mix ratio.

Figure 3:
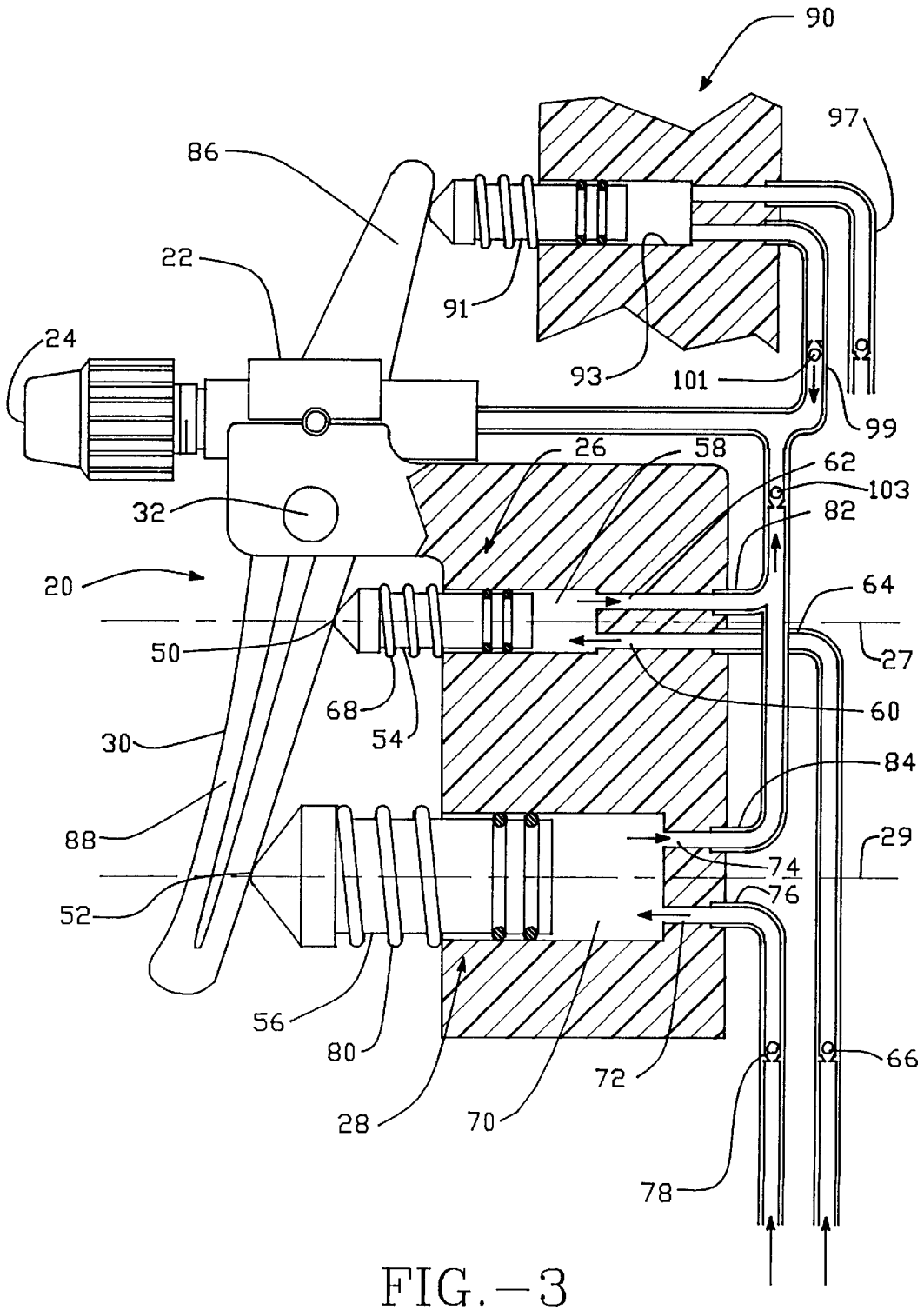
FIG. 3 is a side, partial, cross-sectional view of a proportioning system dispenser which could be used in a handheld trigger sprayer configuration or in a stationary proportioning system.

FIG. 3 depicts a cross-sectional schematic view of another embodiment of the trigger sprayer 20 of the invention. It is noted that in this embodiment, elements similar to elements in the embodiments of FIGS. 1*a*, 1*b*, and 2 are given the same reference numerals. Further, it is noted that even though this configuration is shown to be that of a trigger sprayer it is to be understood that the mechanisms could be scaled up if desired and incorporated into a large scale proportioning system such as for example used in an industrial dishwashing, laundry, or paint mixing environments. In this particular embodiment as described below, both the diameter of the first and second cylinder and piston arrangements 26, 28, and the length of the stroke of the pistons 54, 56, are different in order to account for the mix ratio.

In this embodiment, it can be seen that the first cylinder and piston arrangement 26 includes the above piston 54 positioned in a cylinder 58. Cylinder 58 has inlet port 60 and outlet port 62. Port 60 communicates by way of conduit 64 to, for example, a source of concentrate in a reservoir. A check valve 66 is used to ensure that once it is pumped out of the reservoir, no fluid returns to that reservoir. Piston 54 is biased by spring 68 against the actuator 30 at engagement point 50. Similarly, the second cylinder and piston arrangement 28 includes the above-identified piston 56 housed in the cylinder 70. Cylinder 70 has inlet port 72 and outlet port 74. A conduit 76 communicates the inlet port 72 with a source of fluid through a check valve 78. The piston 56 is biased by spring 80 toward the actuator 30 and contacts the actuator at engagement point 52. The first and second cylinder and piston arrangements 26, 28, are connected to the spray head 22 by first and second conduits 82, 84 respectively.

The actuator 30 (FIG. 3) includes an actuator extension 86 which extends on the other side of the pivot point 32 and in a direction opposite to the main arm 88 of the actuator 30. In this embodiment a third cylinder and piston arrangement 90 is positioned so that it can be pumped by the actuator extension 86. Arrangement 90 includes piston 91, cylinder 93 and biasing spring 95. Conduit 97 communicates with a reservoir of fluid and conduit 99 communicates with nozzle 24. Check valve 101 and 103 prevent back-flow between the first and second cylinder and piston arrangements 26, 28, on the one hand, and third cylinder and piston arrangement 90 on the other hand. It is noted that the actuator 30 has the opposite effect on the third cylinder and piston arrangement 90 that it has on the first and second cylinder and piston arrangement 26, 28. That is to say that when the actuator 30 is pivoted about the pivot point 32 in order to push the pistons into the cylinder of the first and second arrangements 26, 28, fluid is pumped from these arrangements 26, 28 to the spray head. At the same time, the third cylinder and piston arrangement 90 is drawing fluid from a third reservoir. Accordingly, through all actions of the actuator 30, fluid is simultaneously drawn from one or more reservoirs and pumped through the spray head 22. It is to be understood that the third cylinder and piston arrangement 90 could be positioned on the other side of the actuator extension 86, adjacent main arm 88, so that the operation of the actuator with respect to all three of the cylinder and piston arrangement 26, 28, 90, is the same. That is to say that all these arrangements 26, 29, 90 are drawing fluid from a reservoir at the same time or all arrangements 26, 28, 90 are pumping fluid to a spray head at the same time.

Figure 4:
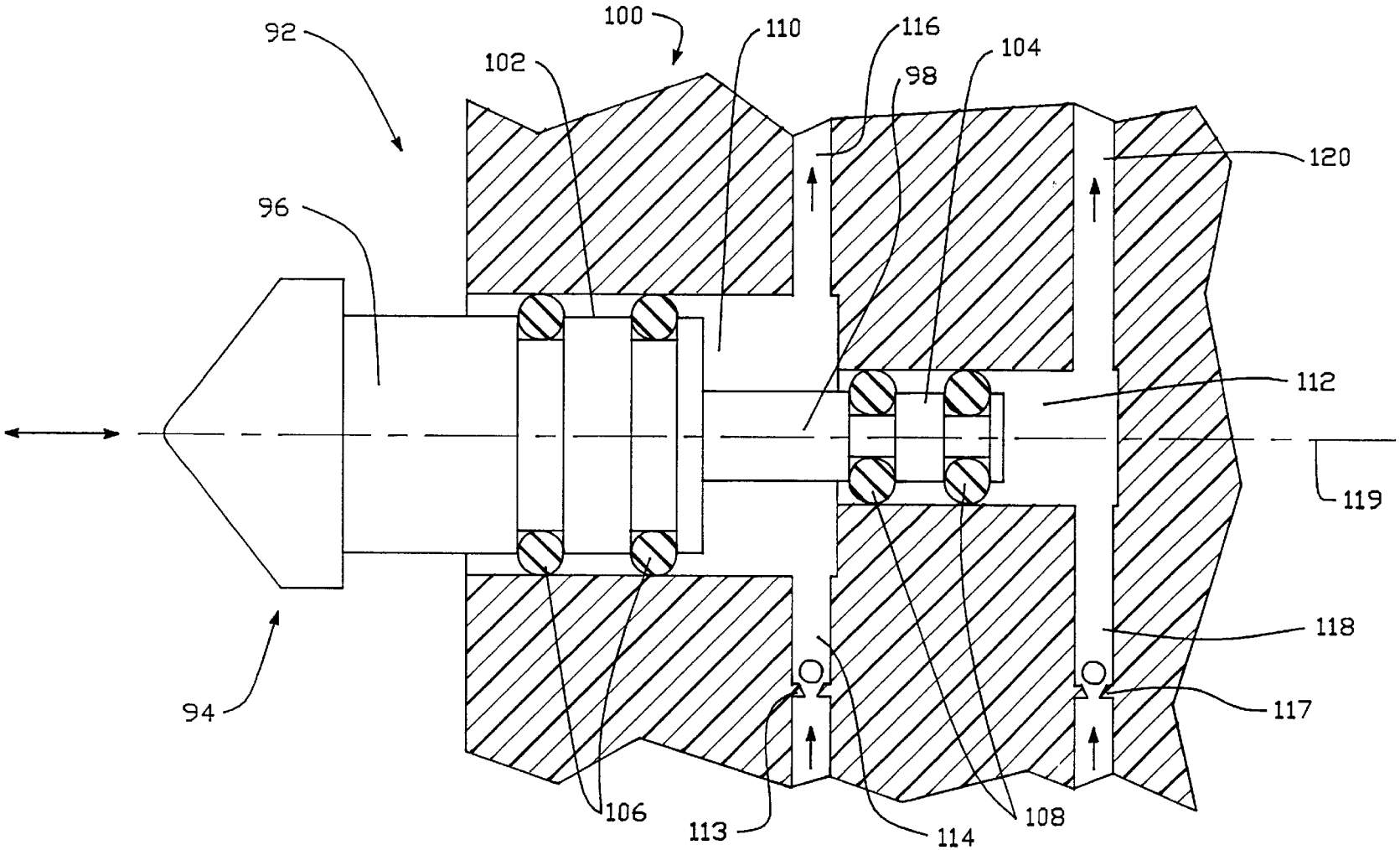
FIG. 4 is an alternative embodiment of a dual piston portioning system.

FIG. 4 is yet another embodiment of an alternative cylinder and piston arrangement 92. This arrangement 92 can replace both of the first and second cylinder and piston arrangements 26, 28 in FIGS. 1, 2 and 3. The alternative cylinder and piston arrangement 92 includes a piston 94 which has a first portion 96 with a first diameter and a second portion 98 with a second diameter. First and second portions 96, 98 are colinear about longitudinal axis 119. In the embodiment depicted, the diameter of the second portion 98 is smaller than the diameter of the first portion 96. However, it is to be understood that the situation could be reversed (or both diameters could be equal) and be within the spirit and scope of this invention. The cylinder 100 has corresponding diameters with first portion 102 of the cylinder 100 having a first diameter and the second portion 104 of the cylinder 100 having a second diameter with the second diameter being smaller than the first diameter. Ring seals, such as seals 106, 108, separate the pump chamber 110 from the pump chamber 112. Pump chamber 110 includes fluid inlet 114 and fluid outlet 116. Pump chamber 112 includes fluid inlet 118 and fluid outlet 120. Check valves 113 and 117 in fluid inlets 114, 118 prevent back-flow into the fluid reservoirs.

Figure 5:
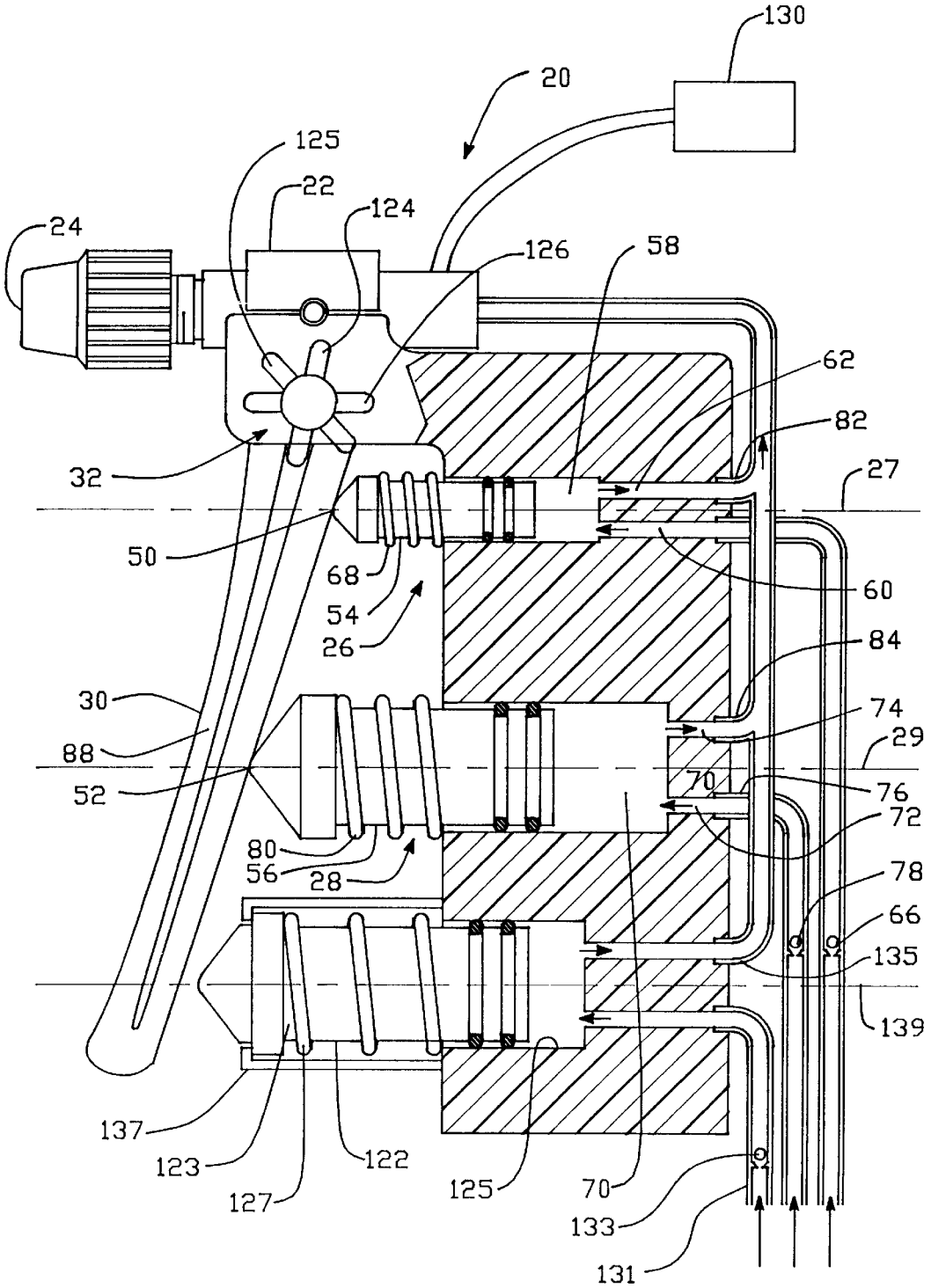
FIG. 5 is yet a further alternative embodiment of the invention wherein the pivot point of the actuator can be repositioned.

A further alternative embodiment of the invention can be seen in FIG. 5. This embodiment is similar to that shown in FIG. 3 with a number of additions. The first addition is the inclusion of another cylinder and piston arrangement 122, with longitudinal axis 139, located adjacent to the first and second cylinder and piston arrangements 26 and 28. Third cylinder and piston arrangement 122 includes a piston 123, a cylinder 125, and a biasing spring 127. Conduit 131 with check valve 133 is connected to a reservoir of fluid, and conduit 135 is connected to spray nozzle 24. Third cylinder and piston arrangement 122 also demonstrates a lost-motion capability so the full extension of piston 123 is restricted by restrictor 137, which does not interfere with actuator 30. In this embodiment, first and second cylinder and piston arrangements 26, 28 operate first, and third cylinder and piston arrangement 122 has a delayed operation. The additional cylinder and piston arrangement 122 has a center line 139 which is substantially parallel to the center lines 27, 29 of the first and second cylinder and piston arrangements 26, 28. In this arrangement three fluids can be apportioned, mixed, and dispensed through the spray head 22.

The additional change in this embodiment is that the pivot point 32 is adjustable. In this arrangement, the adjustability is two-directional, along grooves 124, 125, and 126, which grooves are located at an angle to each other. In the embodiment shown in FIG. 5, grooves 124 and 126 approach being perpendicular to each other. Other orientations of the grooves can be used within the spirit and scope of the invention. Further, it is to be noted that with other mechanisms, the pivot point 32 can be moved out to any desired position. Thus, points that fall outside of grooves 124, 125 and 126 could be chosen as a new pivot point. By moving the pivot point along any of grooves 124, 125 or 126, the influence that the actuator 30 has on the pistons of the first, second, and third cylinder and piston arrangements 26, 28, 122 changes such that the stroke of each piston and thus the volume of fluid pumped and expelled by the first and second cylinder and piston arrangements 26, 28 varies according to the pivot point. Thus by having an appropriate dial or other mechanism affixed to the pivot point 32, the end user can vary the volume dispensed or the mix ratio in the field. Further it is to be noted that for ease of manufacture, such an arrangement can be designed into a universal spray head. Then, in the factory, a one time permanent adjustment can be made to a standard configuration in order to use the same configuration for different mix ratios depending on the fluids to be dispensed from the trigger sprayer 20.

Finally, more to the point of using such a system in a large industrial setting such as with a washer or a paint mixer, a computer controller 130 can be used to adjust the pivot point in order to tune the ratio of the fluids mixed and dispensed by the proportioning system. The computer controller 130 would reposition the pivot point 32 in order to adjust the mix ratio as desired for the particular fluids being mixed or could adaptively change the mix ratio due to changing environment or manufacturing conditions.

Figure 6:
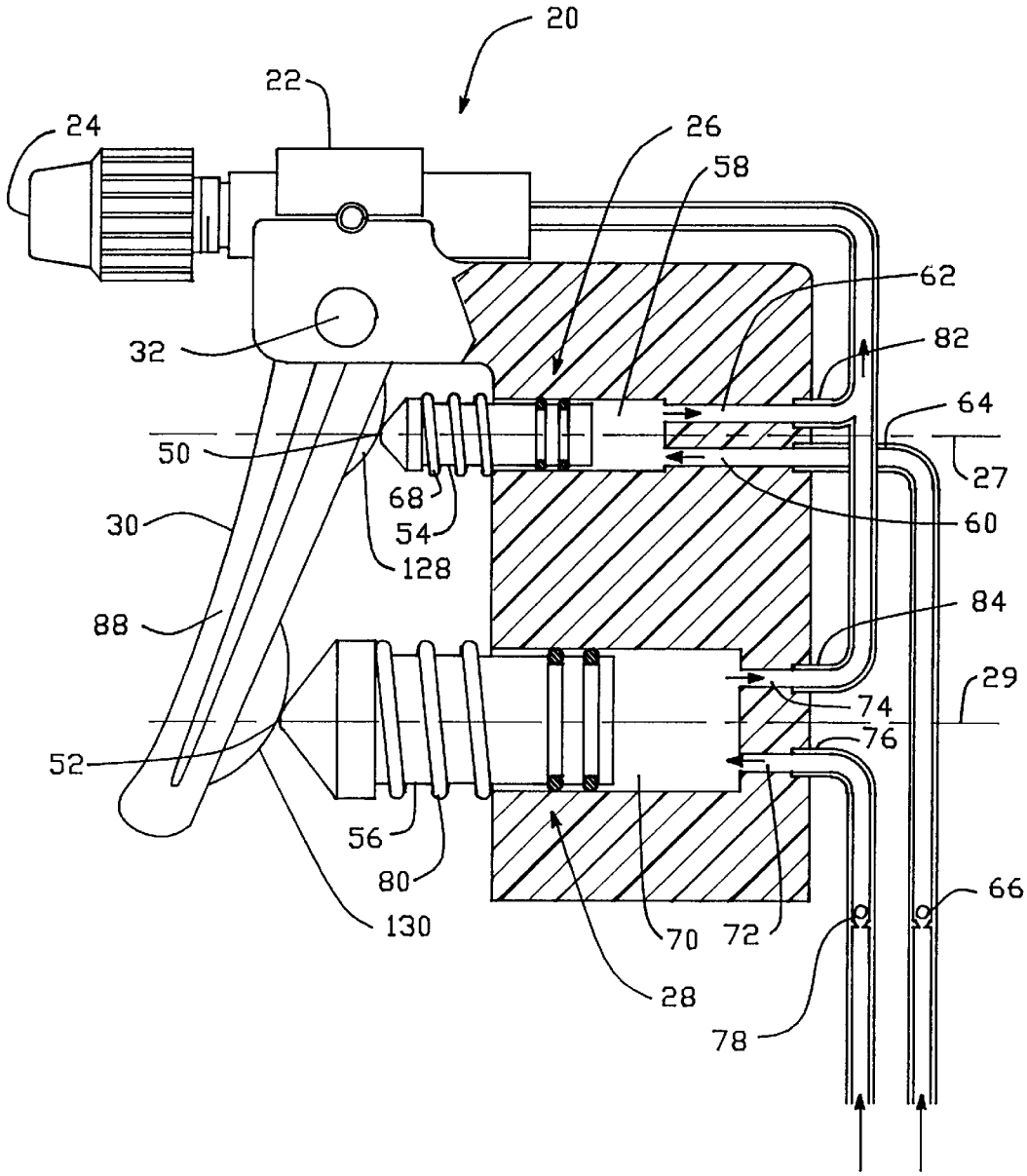
FIG. 6 is still a further alternative embodiment of the invention wherein the stroke of the piston can be adjusted.

With respect to FIG. 6, an alternative embodiment of the sprayer 20 is depicted. This embodiment is somewhat similar to that of FIG. 3 with the addition of mechanisms, dials, cams, and the like for independently adjusting the stroke of each of the cylinder and piston arrangements 26, 28. In this embodiment, the first cam 128 and second cam 130 are affixed to the actuator 30. By adjusting the position of the cams relative to the actuator 30, the length of the stroke of the first and second pistons 54, 56 can be either lengthened or shortened. Such adjustments affect the volume of fluid that is pumped by each of the first and second cylinder and piston arrangements 26, 28. These cams 128, 130 can be for example provided with dials in order to have specified settings.

Figure 7:
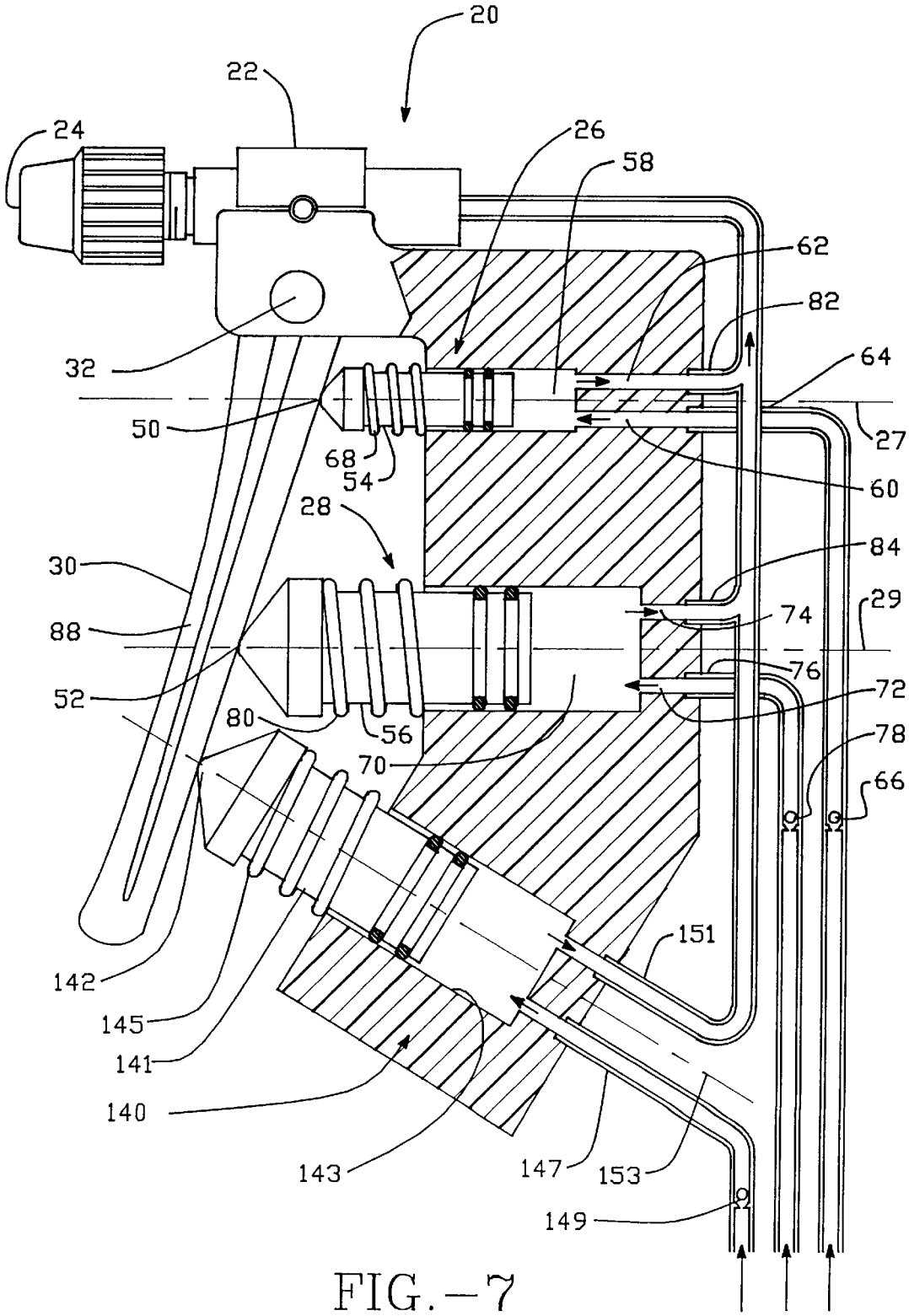
FIG. 7 is yet another alternative embodiment of the present invention wherein the cylinder and piston arrangements are alternatively configured with respect to each other.
Figure 8:
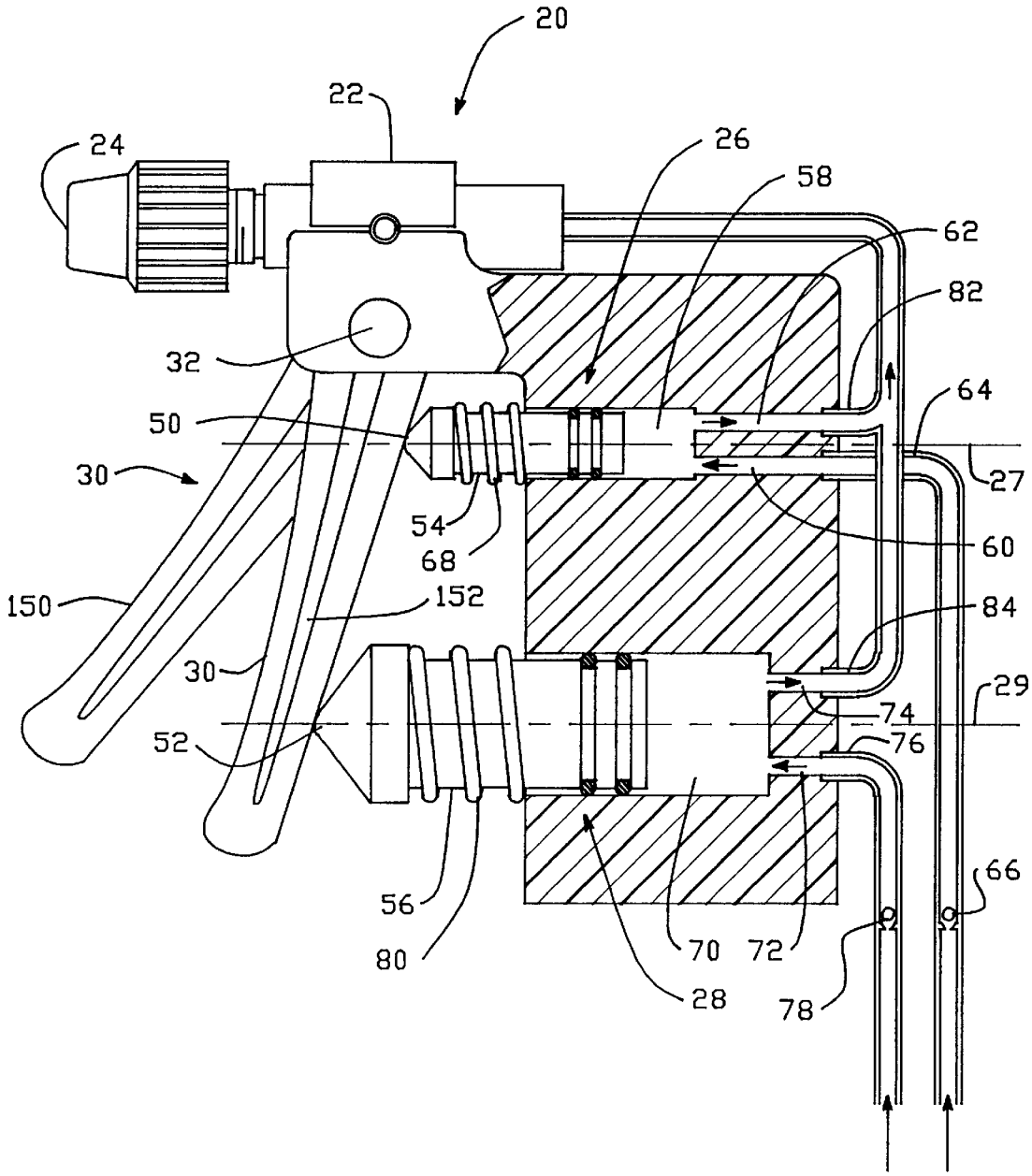
FIG. 8 is a further alternative embodiment of the present invention wherein the actuator includes multiple levers for purposes of effecting the advantages of lost-motion or over-travel in determining the mix ratios.
Figure 9:
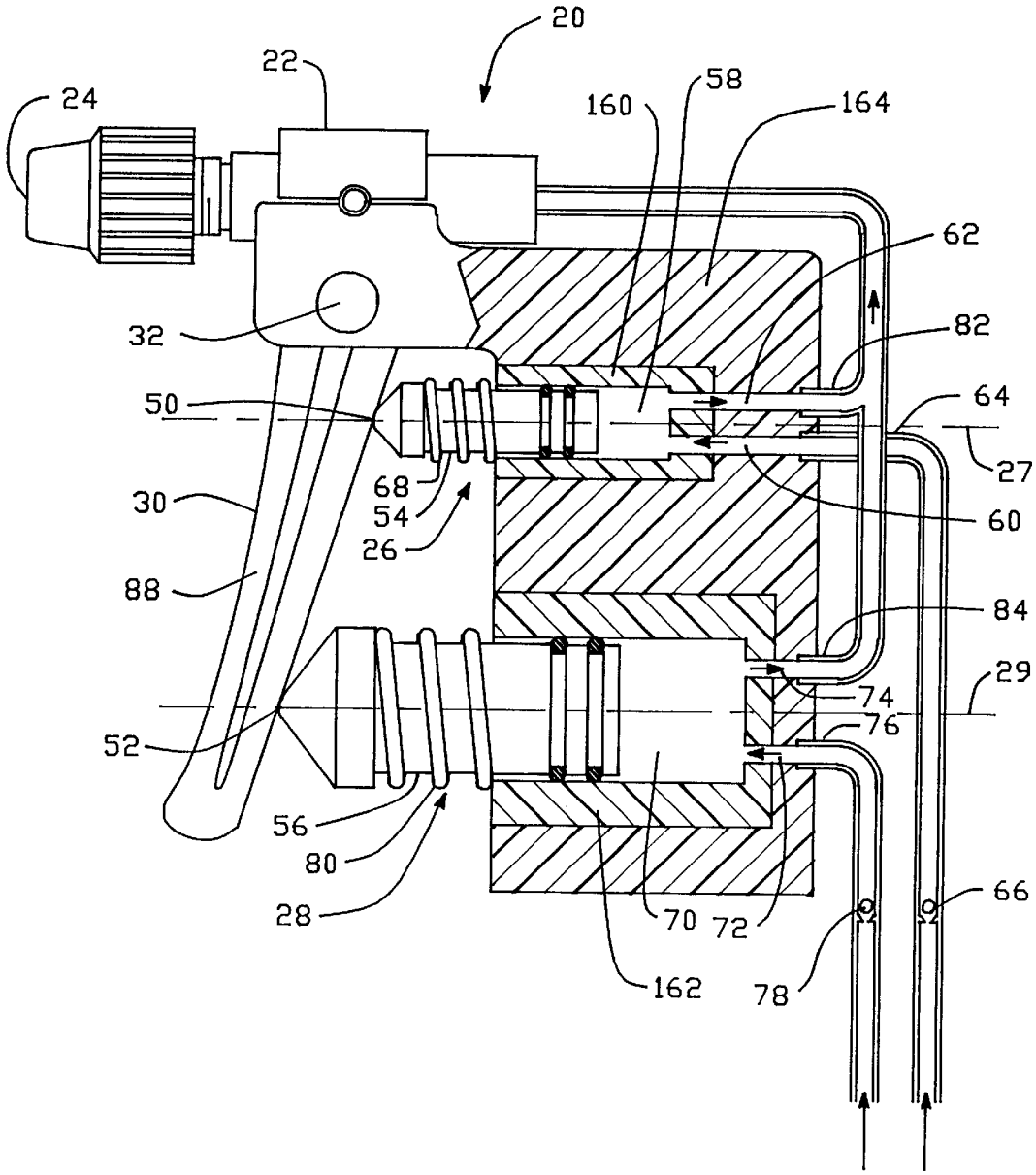
FIG. 9 is yet a further alternative embodiment of the present invention wherein the cylinder and piston arrangements are interchangeable.

FIGS. 7, 8 and 9 are additional embodiments and variations on the above embodiments. In the embodiment in FIG. 7, a third cylinder and piston arrangement 140 is included and positioned below the first and second cylinder and piston arrangements 26, 28. The third cylinder and piston arrangement 140 includes a piston 141, a cylinder 143 and a biasing spring 145. Conduit 147 with check valve 149 is connected to a reservoir of fluid, and conduit 151 is connected to spray nozzle 24. Arrangement 140 has a longitudinal axis 153. This third cylinder and piston arrangement 140, however, is disposed at an angle with respect to the other two such that the longitudinal axis 153 of the third cylinder and piston arrangement 140 is skewed relative to the longitudinal axis of each of the first and the second cylinder and piston arrangement 26, 28. This being the case, the influence of the actuator 30 on the stroke of the piston 142 is different than if the axis of the third cylinder and piston arrangement 140 were parallel to the axes 27, 29 of the first and second cylinder and piston arrangements 26, 28. In the embodiment shown, the stroke would be shortened due to the skewed relationship of the axis of the third cylinder and piston arrangement 140.

Turning to FIG. 8, yet another alternative embodiment of the invention is depicted. In this embodiment, the actuator 30 includes first actuator lever 150 and second actuator lever 152. The first and second actuator levers 150, 152 are arranged in such a relationship so that there is over-travel or lost-motion of one actuator lever with respect to the other actuator lever. That is to say, by way of example only, by engaging the first actuator lever 150, and pivoting it about the pivot point 32, the first cylinder and piston arrangement 26 is put into operation drawing or pumping a fluid. After an interval, the first actuator lever 150 engages the second actuator lever 152 which in turn engages the second cylinder and piston arrangement 28 causing that cylinder and piston arrangement 28 to pump or draw fluid. Thus this lost-motion device affords another dimension to adjusting the mix ratio by, in this case, affecting the stroke of the pistons 54, 56 in the first and second cylinder and piston arrangements 26, 28.

FIG. 9 depicts yet a further alternative embodiment of the invention. In this embodiment, the first and second cylinder and piston arrangements 160, 162, are interchangeable and replaceable. Thus for example, with this basic design, in order to adjust the mix ratio efficiently, preselected cylinder and piston arrangements can be inserted into the base structure 164. Such interchangeable cylinder and piston arrangements can be exchanged either in the factory in the standard base structure 164 or in the field in both a handheld sprayer and also in a industrial or commercial sprayer or proportioner.

Figure 10A:
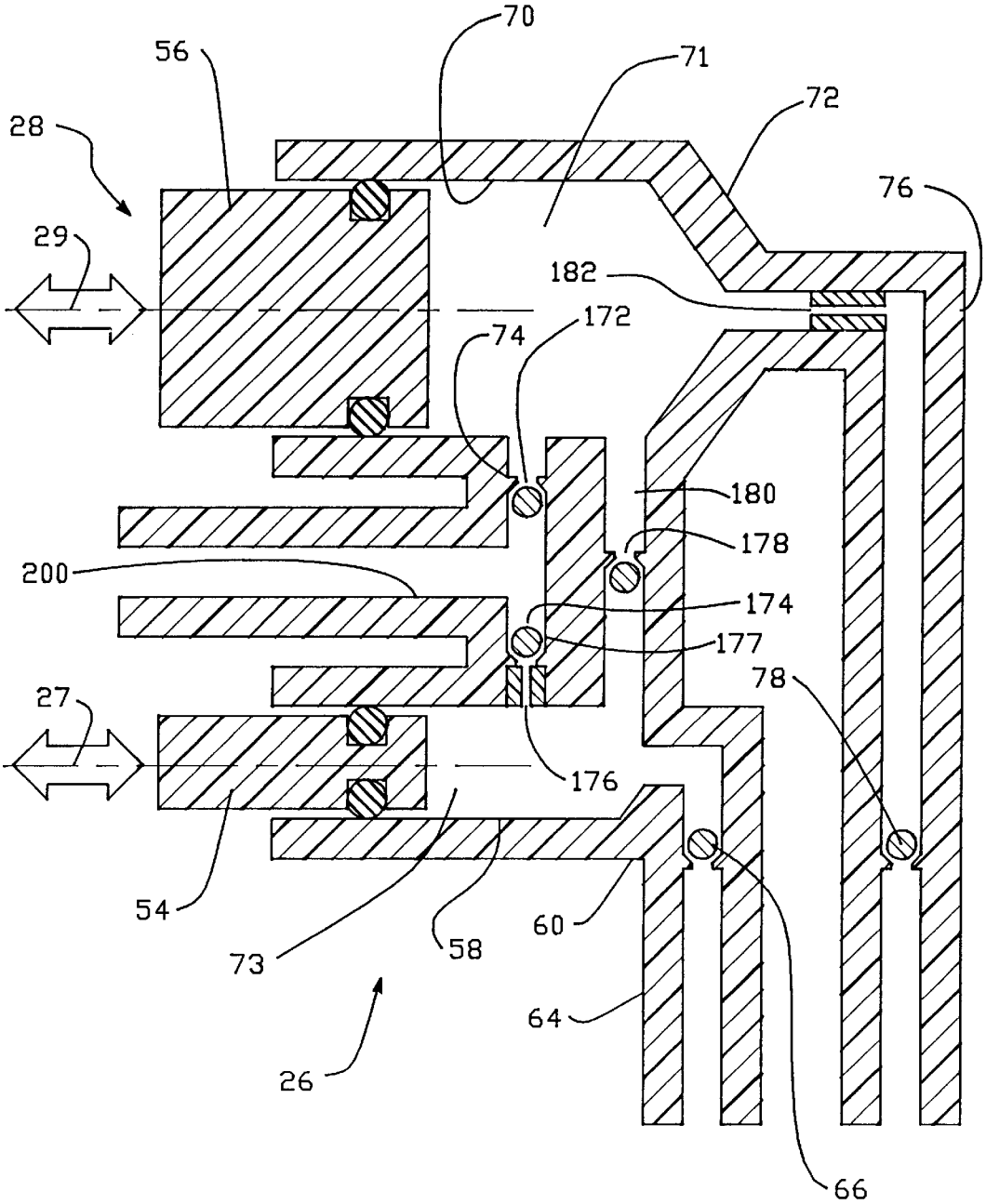
FIGS. 10*a* and 10*b* are alternative embodiments of the valving arrangements of the invention which prevents a concentrate fluid from being dispensed when the diluting fluid has been exhausted.
Figure 10B:
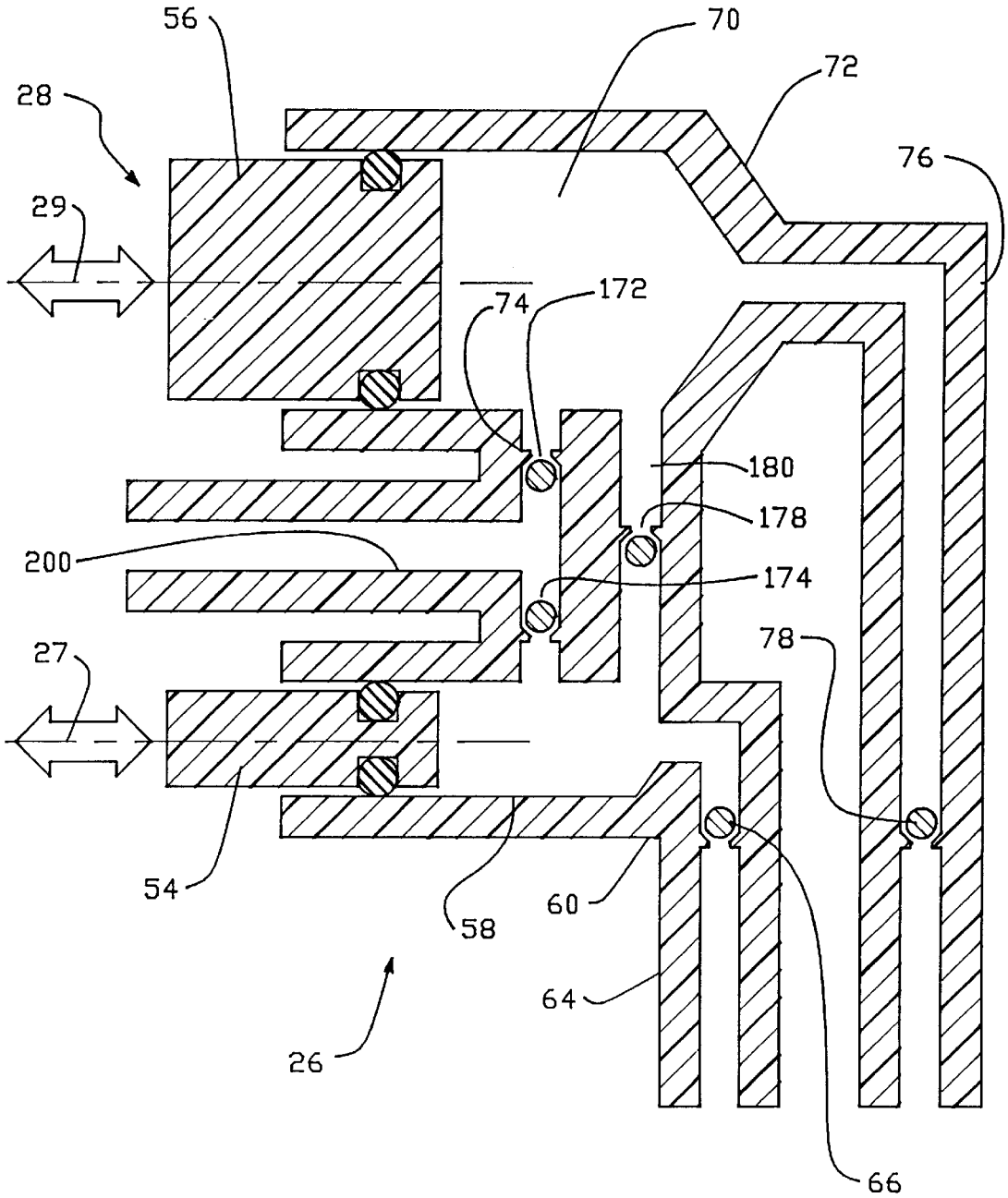

Turning to FIGS. 10*a* and 10*b*, a valve arrangement for ensuring that concentrated fluid is not pumped when the diluting fluid has been depleted is depicted. A schematics of FIGS. 10*a* and 10*b* can be used in conjunction with any of the above embodiments.

In FIG. 10*a* it can be seen that there is one-way check valve 172 in a conduit 74 which prevents fluids from entering chamber 71 of cylinder 70 once it has been expelled by the action of the piston 56. Similarly, there is a one-way check valve 174 in a conduit 177 leading from the outlet of chamber 73 of the first cylinder and piston arrangement 26. In addition to the check valve 174, there is a flow restrictor 176. This flow restrictor 176 is essentially a narrowing of the conduit over a distance. The embodiment of FIG. 10*a* also shows a check valve shunt 178 which is provided in a conduit 180 which connects the chambers 71, 73 of the first and second cylinder and piston arrangements 26, 28. Finally, in this embodiment there is an additional flow restrictor 182 placed in the conduit 76 adjacent the inlet 72 to the second cylinder and piston arrangement 28. Conduits 74 and 177 bring together fluids from chambers 71 and 73 into conduit 200 and allow these fluids to mix and communicate with spray head 22 (not shown). It is noted that the above referenced check valves are preferably elastomeric diaphragm or flapper type check valves.

The operation of this system then is as follows: The flow restrictor 182 is placed in the conduit 76 adjacent the inlet 72 to the second (diluting fluid) cylinder and piston arrangement 28 so that when the pistons 54, 56 are drawing fluid a low pressure region is formed in the chamber 71 of the second cylinder and piston arrangement 28 which is drawing the diluting fluid such as water. At this time, this low pressure ensures that the check valve shunt 178 is closed. The other flow restrictor 176 is placed in the outlet (conduit 177) of the first (concentrated fluid) cylinder and piston arrangement 26, so that when the two pistons are expelling fluid, a high pressure region is formed in the concentrate chamber 73 of the first cylinder and piston arrangement 26. This ensures that the check valve shunt 178 remains closed. When the diluting fluid or water runs out, air is drawn into the chamber 71 of the second (diluting fluid) cylinder and piston arrangement 28, and the pressure drop across the inlet flow inhibitor 182 is small, and thus the pressure within the chamber 71 is higher than the pressure of the chamber 73 drawing in the concentrate. This ensures that the check valve shunt 178 opens and that air enters the concentrate chamber 73. Accordingly, neither diluting fluid nor concentrated fluid reaches conduit 200 and thus, no such fluids are sprayed out.

FIG. 10*b* is similar to FIG. 10*a* with the exception that the flow restrictors 176, 182 are removed. It is to be understood that by the proper selection of the diameters of the tubing that the advantageous feature of FIG. 10*a* can be accomplished in FIG. 10*b* flow without the specific flow restrictors 176, 182 specified in FIG. 10*a*.

INDUSTRIAL APPLICABILITY

From the above, it can be seen that an advantageous proportioning system has been specified which can change the mix ratio as desired and which avoids the dispensing of a concentrated fluid should the diluting fluid be depleted.

Any of the above inventive embodiments can be scaled up from a handheld configuration to a large commercial or industrial application such as for example a paint or epoxy proportioner.

Other aspects, objects and advantages of the invention can be obtained from a review of the figures and the appended claims.

It is to be understood that other embodiments of the present invention be developed and be within the spirit and scope of the invention as claimed.

I claim:

1. A proportioning system comprising:

a first cylinder and piston arrangement;

a second cylinder and piston arrangement;

a dispensing head;

said first cylinder and piston arrangement including an inlet port adapted to be connected to a first reservoir containing a dilution fluid and an outlet port connected to the dispensing head;

said second cylinder and piston arrangement including an inlet port adapted to be connected to a second reservoir containing a concentrated fluid and an outlet port connected to the dispensing head;

said dispensing head adapted for mixing the dilution fluid from the first reservoir with the concentrated fluid from the second reservoir;

a device that connects the first cylinder and piston arrangement to the second cylinder and piston arrangement to ensure that if the dilution fluid is depleted that the concentrated fluid is not dispensed from said proportioning system;

said device further allowing the dilution fluid to be drawn into the first cylinder and piston arrangement and said concentrated fluid to be drawn into said second cylinder and piston arrangement without the dilution fluid and the concentrated fluid being mixed.

2. The proportioning system of claim 1 wherein:

said device is a system of one-way check valves.

3. A proportioning system comprising:

a first cylinder and piston arrangement;

a second cylinder and piston arrangements;

a dispensing head;

said first cylinder and piston arrangement including a first inlet port adapted to be connected to a first reservoir containing a dilution fluid and a first outlet port connected to the dispensing head;

said second cylinder and piston arrangement including a second inlet port adapted to be connected to a second reservoir containing a concentrated fluid and a second outlet port connected to the dispensing head;

said dispensing head adapted for mixing the dilution fluid from the first reservoir with the concentrated fluid from the second reservoir; and a one-way check valve that connects the first cylinder and piston arrangement to the second cylinder and piston arrangement to ensure that if the dilution fluid is depleted that the concentrated fluid is not dispensed from said proportioning system, said one-way check valve having an opened and a closed position;

a first flow restrictor placed in the inlet of said first cylinder and piston arrangement so that when the first cylinder and piston arrangement is drawing the dilution fluid, a low pressure is developed in the first cylinder and piston arrangement, and when the first dilution fluid is depleted and the first cylinder and piston arrangement is attempting to draw fluid, a high pressure is developed in the first cylinder and piston arrangement; and a second flow restrictor placed in the outlet of said second cylinder and piston arrangement so that when the first and second cylinder and piston arrangements are expelling their respective fluids, the one-way check valve is in the closed position.

4. A proportioning system comprising:

a first cylinder and piston arrangement;

a second cylinder and piston arrangement;

a dispensing head;

said first cylinder and piston arrangement including an inlet port adapted to be connected to a first reservoir containing a dilution fluid and an outlet port connected to the dispensing head;

said second cylinder and piston arrangement including an inlet port adapted to be connected to a second reservoir containing a concentrated fluid and an outlet port connected to the dispensing head;

said dispensing head adapted for mixing the dilution fluid from the first reservoir with the concentrated fluid from the second reservoir;

a device that connects the first cylinder and piston arrangement to the second cylinder and piston arrangement to ensure that if the dilution fluid is depleted that the concentrated fluid is not dispensed from said proportioning system; and a flow restrictor placed in the inlet of said first cylinder and piston arrangement so that when the first cylinder and piston arrangement is drawing the dilution fluid, a low pressure is developed in the first cylinder and piston arrangement and when the dilution fluid is depleted and the first cylinder and piston arrangement is attempting to draw fluid, a high pressure is developed in the first cylinder and piston arrangement.

5. A proportioning system comprising:

a first cylinder and piston arrangement;

a second cylinder and piston arrangement;

a dispensing head;

said first cylinder and piston arrangement including an inlet port adapted to be connected to a first reservoir containing a dilution fluid and an outlet port connected to the dispensing head;

said second cylinder and piston arrangement including an inlet port adapted to be connected to a second reservoir containing a concentrated fluid and an outlet port connected to the dispensing head;

said dispensing head adapted for mixing the dilution fluid from the first reservoir with the concentrated fluid from the second reservoir;

a device that connects the first cylinder and piston arrangement to the second cylinder and piston arrangement to ensure that if the dilution fluid is depleted that the concentrated fluid is not dispensed from said proportioning system;

said device has an open and a closed position; and a flow restrictor placed in the outlet of said second cylinder and piston arrangement so that when the first and second cylinder and piston arrangements are expelling their respective fluids, the device is in the closed position.

6. A proportioning system comprising:

a first cylinder and piston arrangement;

a second cylinder and piston arrangement;

a dispensing head;

said first cylinder and piston arrangement including an inlet port adapted to be connected to a first reservoir containing a dilution fluid and an outlet port connected to the dispensing head;

said second cylinder and piston arrangement including an inlet port adapted to be connected to a second reservoir containing a concentrated fluid and an outlet port connected to the dispensing head;

said dispensing head adapted for mixing the dilution fluid from the first reservoir with the concentrated fluid from the second reservoir;

a device that connects the first cylinder and piston arrangement to the second cylinder and piston arrangement to ensure that if the dilution fluid is depleted that the concentrated fluid is not dispensed from said proportioning system; and said device contains a check valve that allows air to flow from the first cylinder and piston arrangement to the second cylinder and piston arrangement when the dilution fluid is depleted.

7. A proportioning system comprising:

a first cylinder and piston arrangement;

a second cylinder and piston arrangement;

a dispensing head;

said first cylinder and piston arrangement including an inlet port adapted to be connected to a first reservoir containing a first fluid and an outlet port connected to the dispensing head;

said second cylinder and piston arrangement including an inlet port adapted to be connected to a second reservoir containing a second fluid and an outlet port connected to the dispensing head;

said dispensing head adapted for mixing the first fluid from the first reservoir with the second fluid from the second reservoir;

a device that connects the first cylinder and piston arrangement to the second cylinder and piston arrangement to ensure that if said first fluid is depleted that said second fluid is not dispensed from said proportioning system; and said device further allowing the first fluid to be drawn into the first cylinder and piston arrangement and the second fluid to be drawn into said second cylinder and piston arrangement without the first and second fluids being mixed.

8. A proportioning system comprising:

a first cylinder and piston arrangement;

a second cylinder and piston arrangement;

a dispensing head;

said first cylinder and piston arrangement including an inlet port adapted to be connected to a first reservoir containing a dilution fluid and an outlet port connected to the dispensing head;

said second cylinder and piston arrangement including an inlet port adapted to be connected to a second reservoir containing a concentrated fluid and an outlet port connected to the dispensing head;

said dispensing head adapted for mixing the dilution fluid from the first reservoir with the concentrated fluid from the second reservoir; and a valve device that connects the first cylinder and piston arrangement to the second cylinder and piston arrangement to ensure that if the dilution fluid is depleted that the concentrated fluid is not dispensed from said proportioning system.

9. A proportioning system comprising:

a first cylinder and piston arrangement;

a second cylinder and piston arrangement;

a dispensing head;

said first cylinder and piston arrangement including an inlet port adapted to be connected to a first reservoir containing a first fluid and an outlet port connected to the dispensing head;

said second cylinder and piston arrangement including an inlet port adapted to be connected to a second reservoir containing a second fluid and an outlet port connected to the dispensing head;

said dispensing head adapted for mixing the first fluid from the first reservoir with the second fluid from the second reservoir; and a valve device that connects the first cylinder and piston arrangement to the second cylinder and piston arrangement to ensure that if the first fluid is depleted the second fluid is not dispensed from said proportioning system.

* * * * *